US005447819A

United States Patent [19]

Mooberry et al.

[11] Patent Number: 5,447,819

[45] Date of Patent: Sep. 5, 1995

[54] PHOTOGRAPHIC ELEMENT CONTAINING HIGH DYE-YIELD COUPLERS HAVING IMPROVED REACTIVITY

[75] Inventors: Jared B. Mooberry; James J. Seifert; David Hoke, all of Rochester; Zheng Z. Wu, Penfield; David T. Southby, Rochester; Frank D. Coms, Fairport, all of N.Y.

[73] Assignee: Eastman Kodak Company, Rochester, N.Y.

[21] Appl. No.: 250,416

[22] Filed: May 27, 1994

[51] Int. Cl.[6] ..... G03C 7/333

[52] U.S. Cl. ..... 430/226; 430/359; 430/549; 430/559; 430/955; 430/557

[58] Field of Search ..... 430/226, 557, 559, 560, 430/561, 562, 563, 955, 958, 359, 549

[56] References Cited

U.S. PATENT DOCUMENTS

| | | | |
|---|---|---|---|
| 4,248,962 | 2/1981 | Lau | 430/382 |
| 4,401,752 | 8/1983 | Lau | 430/553 |
| 4,409,323 | 10/1983 | Sato et al. | 430/544 |
| 4,840,884 | 6/1989 | Mooberry et al. | 430/958 |
| 4,861,701 | 8/1989 | Burns et al. | 430/543 |
| 5,034,311 | 7/1991 | Slusarek et al. | 430/544 |
| 5,055,385 | 10/1991 | Slusarek et al. | 430/544 |
| 5,250,395 | 10/1993 | Kamada et al. | 430/226 |

*Primary Examiner*—Lee C. Wright
*Attorney, Agent, or Firm*—Arthur E. Kluegel

[57] ABSTRACT

The invention provides a photographic element comprising a support bearing a photographic silver halide emulsion layer having associated therewith a high dye-yield coupler having the formula:

$$\text{COUP}—(\text{T})_m—\text{L}—\text{DYE}$$

where COUP is the parent group of the coupler capable of reacting at the coupling position with oxidized color developer to form a first dye, T is one or more timing groups with m=1 or 2, L is a linking group selected from the group consisting of —OC(O)—, —OC(S)—, —SC(O)—, —SC(S)—, or —OC(=N $SO_2R$)—, where R is substituted or unsubstituted alkyl or aryl, and DYE is a second dye or precursor thereof, wherein there is present at least one T group that contains a substituent having the formula:

$$—(\text{LINK})_p—\text{A}—\text{B}—(\text{C}—\text{D})_n$$

wherein:

LINK is an alkylene group capable of linking the above group to the group T, where p=0 or 1;

A is a member selected from the group consisting of —NHCO—, —N(R')C(O)N(R—)—, —CONH—, —NR'$SO_2$—, —$SO_2$NR'—, and —$OPO_2$—, where R' is hydrogen or substituted or unsubstituted alkyl;

B is a substituted or unsubstituted aromatic carbocyclic or heterocyclic group;

C is a solubilizing group selected from —$NHSO_2$— and —$SO_2$NH—;

D is a substituted or unsubstituted alkyl, aryl, or heterocyclic ring; and n is from 1 to 3.

The invention also provides a photographic coupler, a photographic silver halide emulsion, and a process for forming an image in a photographic element in accordance with the invention.

17 Claims, No Drawings

PHOTOGRAPHIC ELEMENT CONTAINING HIGH DYE-YIELD COUPLERS HAVING IMPROVED REACTIVITY

FIELD OF THE INVENTION

This invention relates to a photographic element which exhibits improved properties through the incorporation of a certain high dye-yield coupler which contains at least one timing group having a particular solubilizing substituent to improve photographic reactivity.

BACKGROUND OF THE INVENTION

Useful high dye yield (HDY) couplers have been disclosed by Mooberry and Singer in U.S. Pat. No. 4,840,884. Such couplers react with oxidized color developer to form one dye and in doing so release a precursor of a second dye. It has been found, however, that couplers of this type, containing a coupler portion capable of forming a yellow dye upon coupling with oxidized developer, are not always satisfactory from the standpoint of reactivity.

U.S. Pat. No. 4,401,752 discloses that the coupling efficiency of pivaloylacetanilide types of yellow couplers can be improved by providing an aryloxy coupling-off group in which a polarizable carbonyl, sulfonyl, or phosphonyl group is attached to the phenyl ring at the ortho position. Small chain length sulfonamido groups such as methylsulfonamido are exemplified. The use of hydrophilic groups which affect the properties of couplers containing timing groups is disclosed in, for example, U.S. Pat. Nos. 4,248,962, 4,861,701, 4,409,323, 5,034,311, and 5,055,385. However, there is no suggestion in the art of the particular advantages to be obtained from the use of a timing group having a substituent containing a sulfonamidoaryl or sulfamoylaryl portion in conjunction with a high dye-yield coupler.

It is a problem to be solved to provide a photographic element, coupler, emulsion and imaging process that provide a yellow dye forming high dye-yield coupler which has improved reactivity and photographic properties.

SUMMARY OF THE INVENTION

The invention provides a photographic element comprising a support bearing a photographic silver halide emulsion layer having associated therewith a high dye-yield coupler having the formula:

$$\text{COUP}—(\text{T})_m—\text{L}—\text{DYE}$$

where COUP is the parent group of the coupler capable of reacting at the coupling position with oxidized color developer to form a first dye, T is one or more timing groups with m=1 or 2, L is a linking group selected form the group consisting of —OC(O)—, —OC(S)—, —SC(O)—, —SC(S)—, or —OC(=$NSO_2R$)—, where R is substituted or unsubstituted alkyl or aryl, and DYE is a second dye or precursor thereof, wherein there is present at least one T group that contains a substituent having the formula:

$$—(\text{LINK})_p—\text{A}—\text{B}—(\text{C}—\text{D})_n$$

wherein:

LINK is an alkylene group capable of linking the above group to the group T, where p=0 or 1;

A is a member selected from the group consisting of —NHCO—, —N(R')C(O)N(R')—, —CONH—, —NR'$SO_2$—, —$SO_2$NR'—, and —$OPO_2$—, where R' is hydrogen or substituted or unsubstituted alkyl;

B is a substituted or unsubstituted aromatic carbocyclic or heterocyclic group;

C is a solubilizing group selected from —$NHSO_2$— and —$SO_2$NH—; and

D is a substituted or unsubstituted alkyl, aryl, or heterocyclic ring, and n is from 1 to 3.

The invention also provides a photographic coupler, a photographic silver halide emulsion, and a process for forming an image in a photographic element in accordance with the invention.

The photographic element, coupler, silver halide emulsion, and imaging process provide improved reactivity and photographic properties.

DETAILED DESCRIPTION OF THE INVENTION

The dye forming coupler of the invention has the general formula:

$$\text{COUP}—(\text{T})_m—\text{L}—\text{DYE}$$

where COUP is the parent group of the coupler capable of reacting at the coupling position with oxidized color developer to form a first dye, T is one or more timing groups with m=1 to 2, L is a particular linking group, and DYE is a second dye.

COUP is the parent portion of a coupler that is capable of coupling with oxidized developer to form a dye. As described more fully hereafter, the dye formed upon coupling with oxidized developer is yellow in color. Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

T is a timing group which, as indicated by the value range for m of from 0 to 2, may be absent or may represent one or two such timing groups. Such groups are well-known in the art such as (1) groups utilizing the cleavage reaction of a hemiacetal (U.S. Pat. No. 4,146,396, Japanese Applications 60-249148; 60-249149); (2) groups utilizing an electron transfer reaction along a conjugated system (U.S. Pat. Nos. 4,409,323; 4,421,845; Japanese Applications 57-188035; 58-98728; 58-209736; 58-209738); (3) groups utilizing the cleavage of imino ketals (U.S. Pat. No. 4,546,073); (4) groups that function as a coupler or reducing agent after the coupler reaction (U.S. Pat. No. 4,438,193; U.S. Pat. No. 4,618,571); and (5) groups using an intramolecular nucleophilic substitution reaction (U.S. Pat. No. 4,248,962). The timing group to which the L-DYE group of the invention is optionally attached is any one which will permit release of the L-DYE group. Foregoing groups (5) is not suitable as the group to release L-DYE but could serve as the first of a sequence of two timing groups. Other timing groups are generally suitable for releasing —L—DYE. Timing groups as described under (2) and the listed patents are most suitable. Generally these consist of a bond from COUP or another timing group to an oxygen atom which is bonded to a substituted or unsubstituted aromatic hydrocarbyl or heterocyclic ring at a location in conjugation with a methyl group on the ring which may optionally be substituted with one or two alkyl groups, where the methyl group is bonded to L—DYE or a second timing group. A typical such group based on an aromatic hydrocarbyl group has the formula:

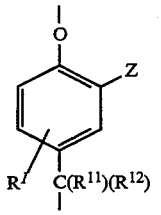

wherein Z is selected from the group consisting of nitro, cyano, alkylsulfonyl; sulfamoyl ($—SO_2NR2$); and sulfonamido ($—NRSO_2R$) groups; R is hydrogen or a substituent such as alkyl; $R^I$, $R^{11}$ and $R^{12}$ are independently hydrogen or substituents that do not adversely affect the coupling and release reactions or the properties of the dyes formed thereby.

One example of such a group containing an aromatic heterocycle is:

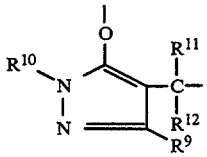

where $R^9$ through $R^{12}$ are independently hydrogen or substituents that do not adversely affect the coupling and release reactions or the properties of the dyes formed thereby.

L is a group which serves to connect T to the second dye. L has a formula so as to permit —L—DYE or $—(T)_m—L—DYE$ to be cleaved from the coupler upon the coupler's oxidative coupling with color developer during development processing. COUP combines with the oxidized developer to form the first dye and the fragment —L—DYE or $—(T)_m—L—DYE$ is then freed from COUP. Suitable groups for L are —OC(O)—, —OC(S)—, —SC(O)—, —SC(S)—, or $—OC(=NSO_2R)—$, where R is substituted or unsubstituted alkyl or aryl. Such groups permit the cleavage of the fragment from COUP and are cleaved from DYE. U.S. Pat. No. 4,840,884 generally describes photographic elements employing high dye yield couplers having electrically neutral chromophores, and the contents thereof are incorporated herein by reference. Further, particularly suitable couplers containing a methine dye chromophore are described in an application of Mooberry et al entitled "Photographic Element Containing A High Dye-Yield Coupler With A Methine Dye Chromophore" which is cofiled herewith.

The coupler of the invention releases a second dye having an electrically neutral chromophore. By this is meant that the chromophore at its characteristic hue bears no formal electrical charge. The second dye of the invention suitably contains a substituted nitrogen group which is bonded to the linking group. Such dyes may be any of the types disclosed, for example, in the aforementioned U.S. Pat. No. 4,840,884 and may be synthesized as described therein.

The DYE as described includes: any releasable, electrically neutral dye that enables due hue stabilization without mordanting the dye formed. The release mechanism can be initiated by oxidized reducing agent.

In U.S. Pat. No. 4,840,884, the term DYE is defined so that the adjacent nitrogen atom is not a part of DYE while the definition herein does include the nitrogen atom. In either case, the composition of the dye formed by release is the same.

The $R^1$ substituent on $—NR^1—$ can be any substituent that does not adversely affect the coupler. When the $—NR^1—$ is part of an auxochrome, $R^1$ can be, for example, hydrogen or alkyl, such as alkyl containing 1 to 42 carbon atoms, including methyl, ethyl, propyl, n-butyl, t-butyl or eicosyl, or aryl, such as phenyl. When the nitrogen atom attached to L is part of a chromophore, $R^1$ becomes an integral part of the chromophore. Preferred $R^1$ groups are alkyl, such as alkyl containing 1 to 18 carbon atoms when $R^1$ is part of the dye auxochrome. $R^1$ when part of the chromophore is, for example, unsubstituted or substituted aryl, such as phenyl.

The selection of the type and size of the substituents of DYE can be made in order to provide a partition coefficient of DYE which permits the desired degree of diffusion.

Particularly useful classes of DYE moieties are:

I. Azo dye moieties including the $—NR^1—$ group represented by the structure:

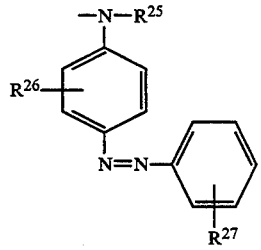

wherein $R^{25}$ is hydrogen or a substituent, such as alkyl and $R^{26}$ and $R^{27}$ independently represent hydrogen or one or more substituents such as alkyl.

II. Azamethine dye moieties including the $—NR^1—$ group represented by the structure:

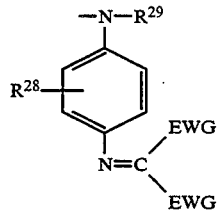

wherein $R^{28}$ is hydrogen or one or more substituents, such as alkyl; $R^{29}$ is hydrogen or a substituent, such as alkyl; and EWG is an electron withdrawing group.

III. Methine dye moieties including the $—NR^1—$ group represented by the structure:

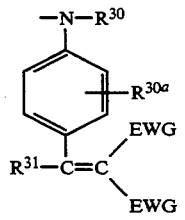

wherein $R^{30}$ and $R^{31}$ are independently hydrogen or a substituent, such as alkyl; $R^{30a}$ is hydrogen or one or more substituents such as alkyl; and EWG is an electron withdrawing group having a positive Hammett's sigma(para) value.

The term DYE also includes dye precursors wherein the described substituted nitrogen atom is an integral part of the chromophore, also described herein as leuco dye moieties. Such dye precursors include, for example:

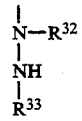

wherein $R^{32}$ is a group that is cleaved during processing to leave NH, or N=N, and $R^{33}$ is aryl, such as substituted phenyl.

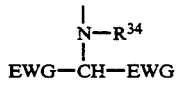

wherein $R^{34}$ is a group that is cleaved during processing to leave NH or N=C; and EWG is an electron withdrawing group as defined above.

Suitable examples of a yellow dye formed upon release may have, for example, the formula:

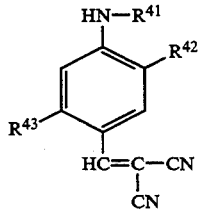

wherein $R^{41}$ is alkyl; $R^{42}$ is alkoxy, alkyl, or H; and $R^{43}$ is alkyl or H; and

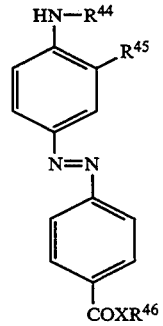

wherein $R^{44}$ is alkyl; $R^{45}$ is alkoxy, alkyl, or H; $R^{46}$ is alkyl or aryl; and X is —O— or —NR*— where R* is H, alkyl, or aryl.

The group LINK is optionally present as indicated by p=0 or p=1. LINK is an alkylene group, suitably of less than 3 carbon atoms and is preferably a methylene group.

A is a member selected from the group consisting of —NHCO—, —N(R')C(O)N(R')—, —CONH—, —NR'$SO_2$—, —$SO_2$NR'—, and —$OPO_2$—, where R' is hydrogen or substituted or unsubstituted alkyl. Suitably, A is —NHCO—, —$NHSO_2$—, or —$SO_2$NH—. The group A is one that serves to bond the solubilizing group to the remainder of the molecule.

B is a substituted or unsubstituted aromatic carbocyclic or heterocyclic group; suitably, B is a phenyl group, which is further substituted by a —C—D group or groups.

C is a solubilizing group selected from —$NHSO_2$— and —$SO_2$NH—, and is most suitably —$NHSO_2$—.

D is a substituted or unsubstituted alkyl, aryl, or heterocyclic ring. Suitably, D is a substituted or unsubstituted alkyl of low carbon number such as methyl, ethyl, or trifluoromethyl.

n is from 1 to 3 where the n —(C—D) groups are individually bonded to the cyclic group B rather than to each other.

The solubilizing substituent is most suitably attached to the group T at any position of the ring structure of T. The substituent is most suitably one having one of the structures:

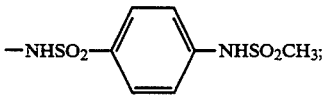

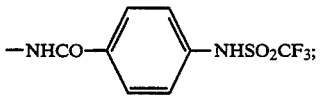

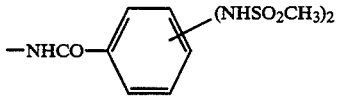

The following formulas illustrate suitable couplers on the invention and show some comparative couplers (Comp-1 through 3) which are similar in structure but do not provide the desired improvements in the reactivity of the coupler.

| COUPLER | FORMULA |
|---|---|
| | 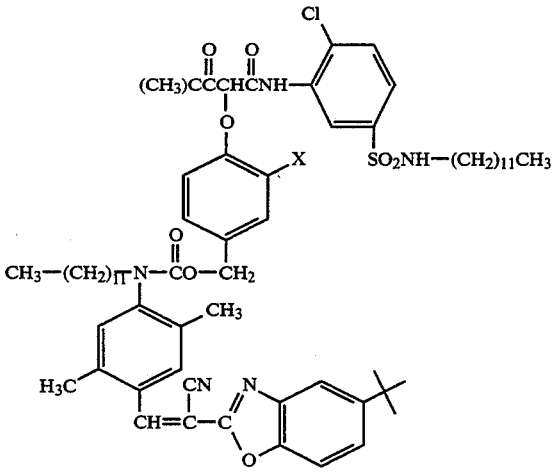 |
| Comp-1 | X = —NHSO$_2$CH$_3$ |
| Inv-1 | X = —NHSO$_2$— 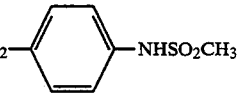 —NHSO$_2$CH$_3$ |
| | 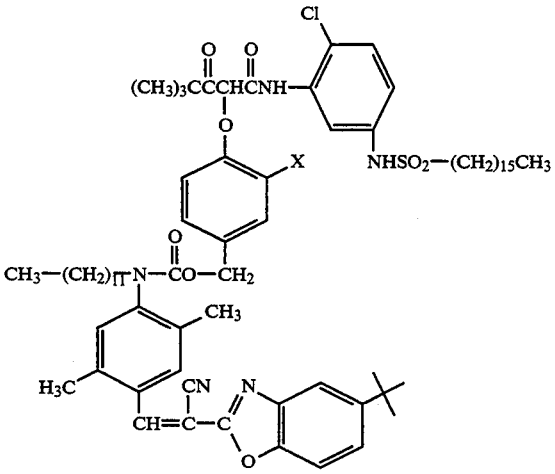 |
| Comp-2 | X = —NHCO(CH$_2$)$_3$CO$_2$H |
-continued
| COUPLER | FORMULA |
|---|---|
| Inv-2 | X = —NHSO$_2$— 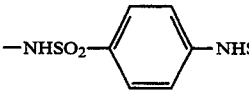 —NHSO$_2$CH$_3$ |
| Inv-3 | X = —NHCO— 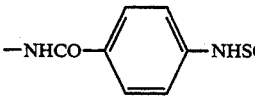 —NHSO$_2$CF$_3$ |
| | 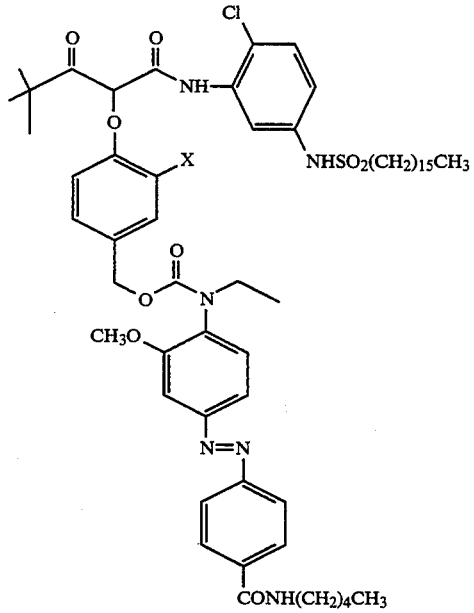 |
| Comp-3 | X = —NHCO(CH$_2$)$_3$CO$_2$H |
| Inv-4 | X = —NHSO$_2$— 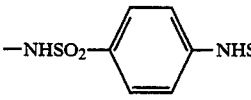 —NHSO$_2$CH$_3$ |
| Inv-5 | X = —NHCO— 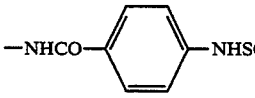 —NHSO$_2$CF$_3$ |
The following are further examples of couplers of the invention
Inv-6
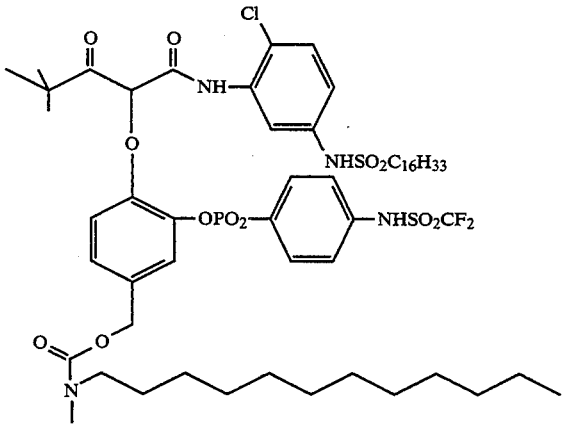

-continued
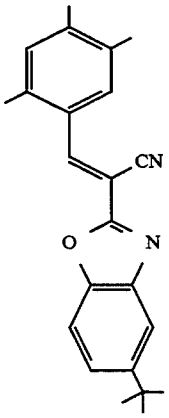
Inv-7
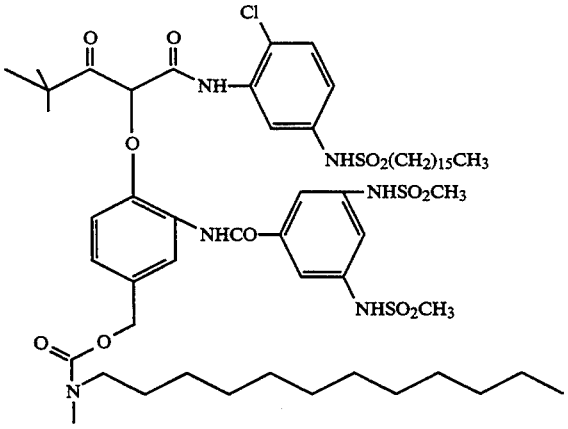
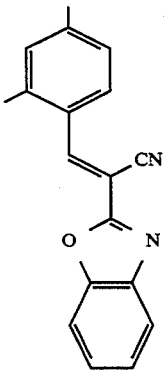
Inv-8
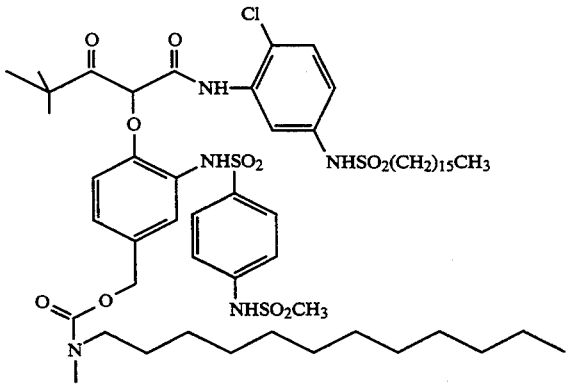

-continued
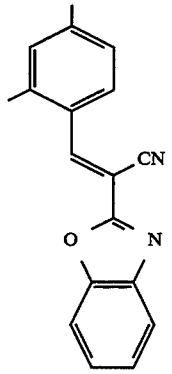
Inv-9
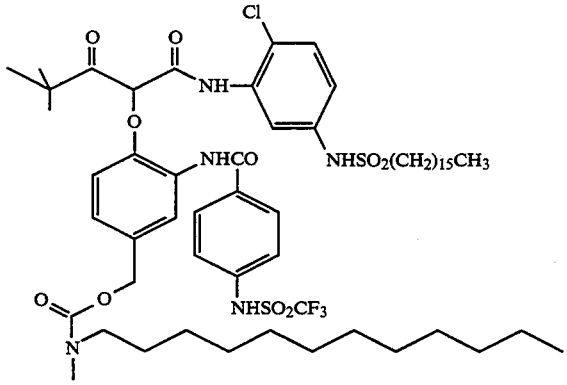
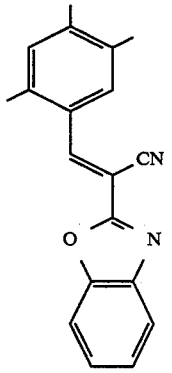
Inv-10
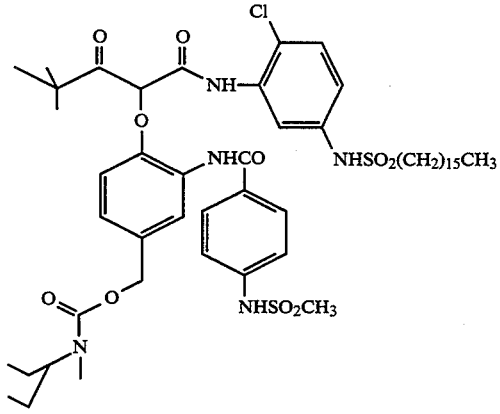

-continued
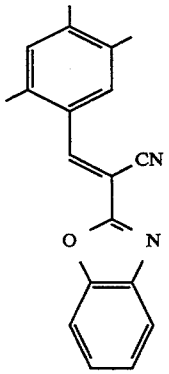
Inv-11
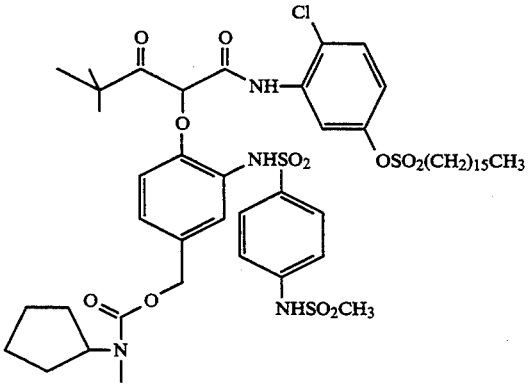
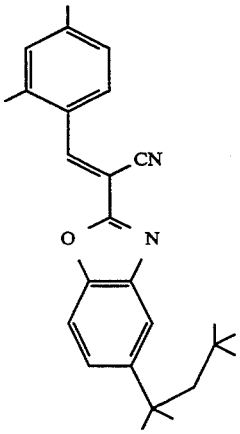
Inv-12
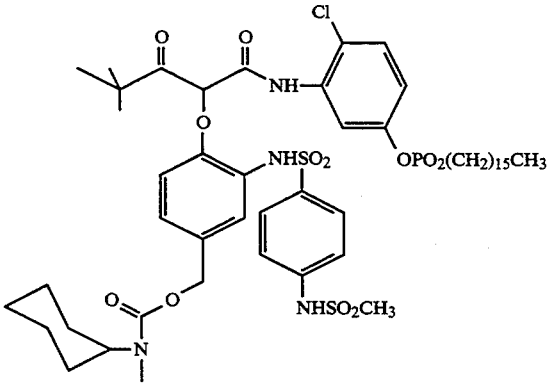

-continued
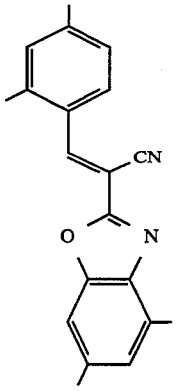
Inv-13
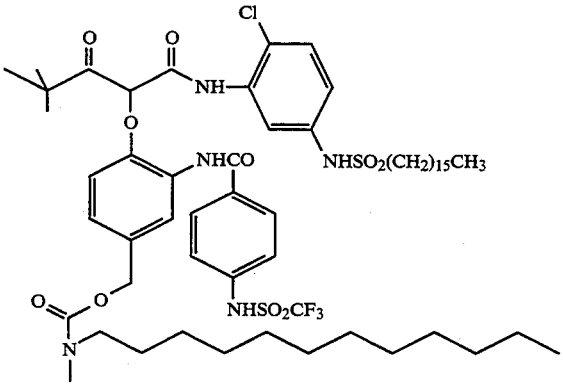
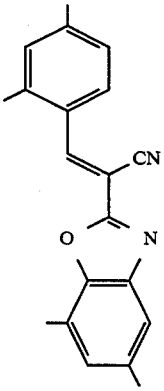
Inv-14
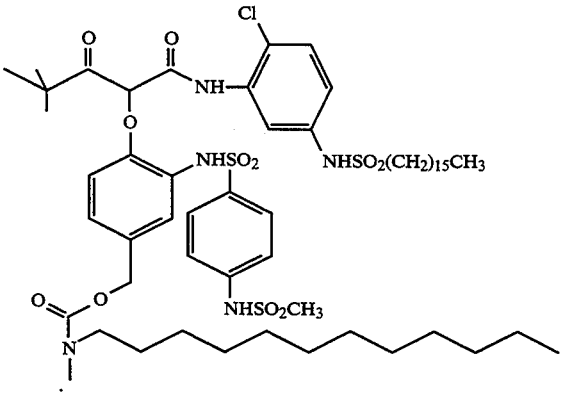

-continued
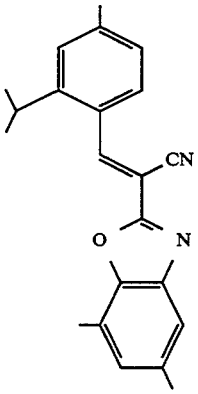
Inv-15
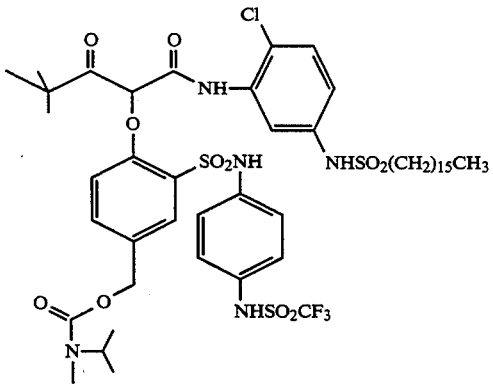
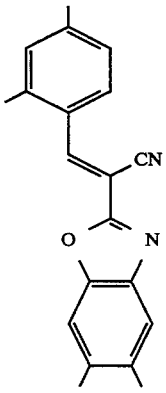
Inv-16
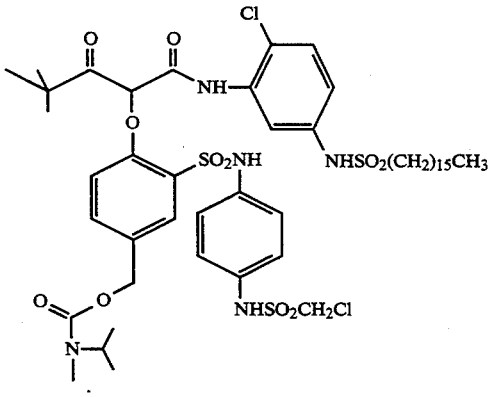

-continued
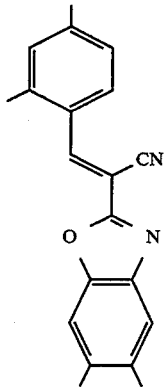
Inv-17
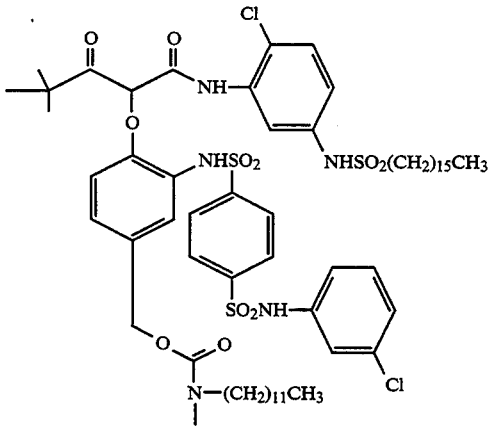
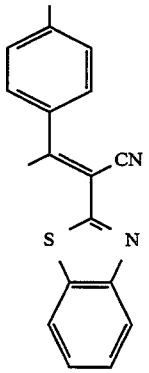
Inv-18
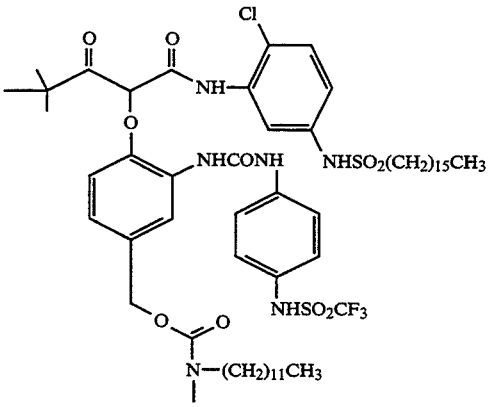

-continued
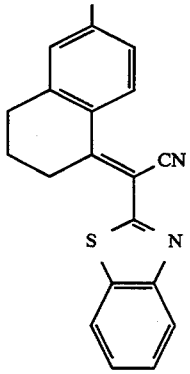
Inv-19
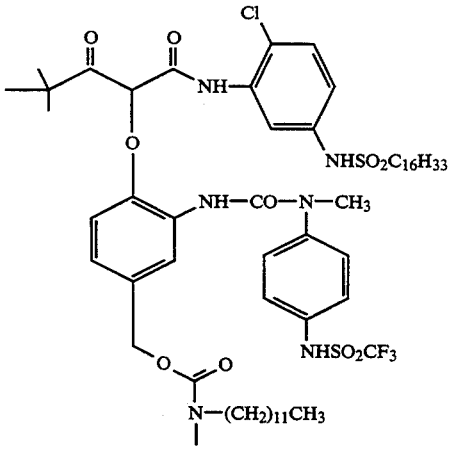
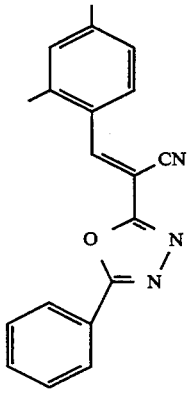
Inv-20
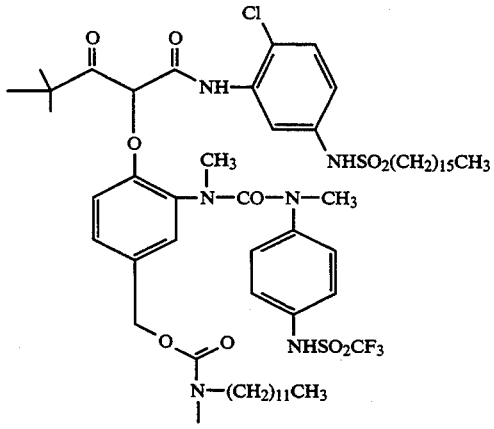

-continued
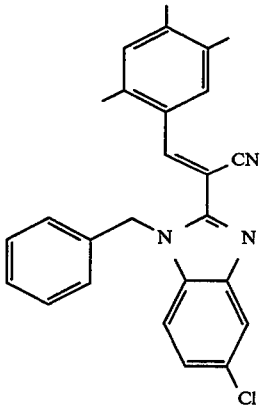
Inv-21
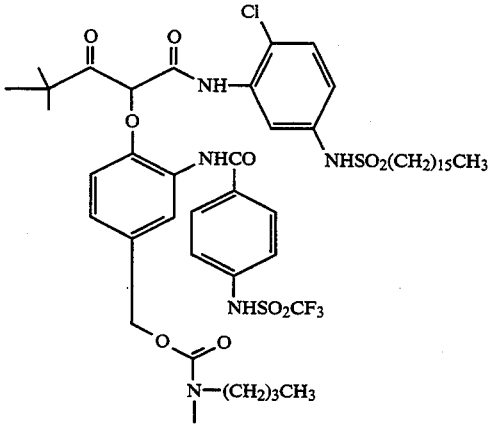
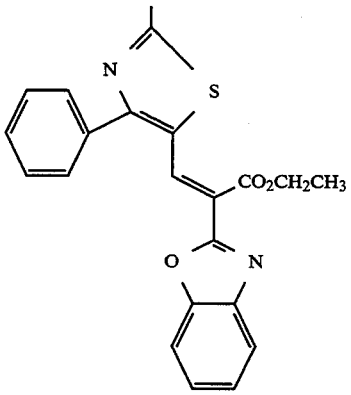
Inv-22
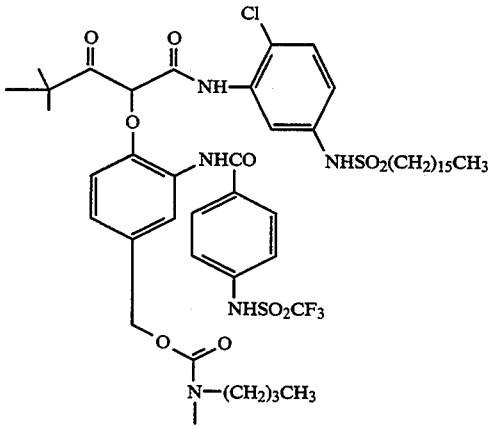

-continued
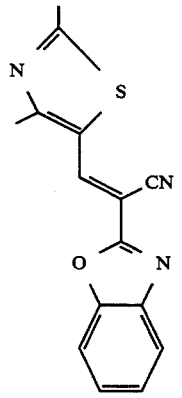
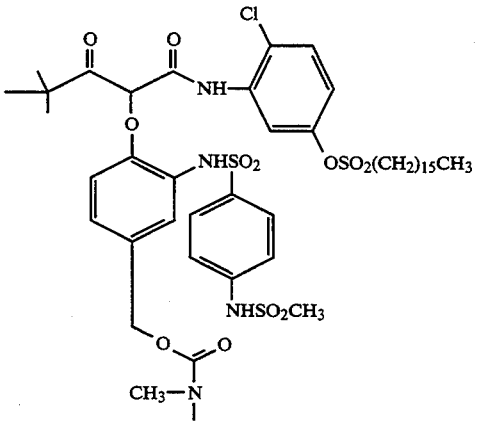
Inv-23
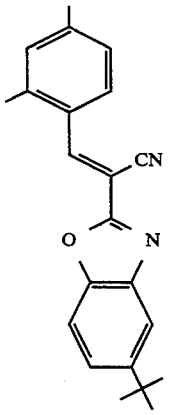
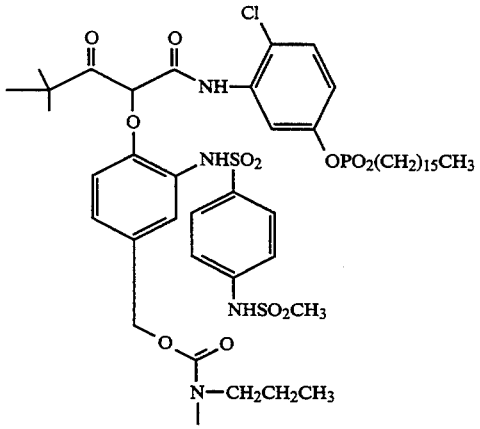
Inv-24

-continued
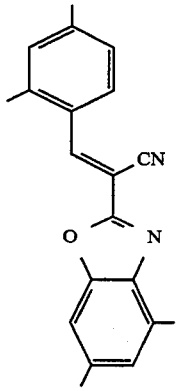
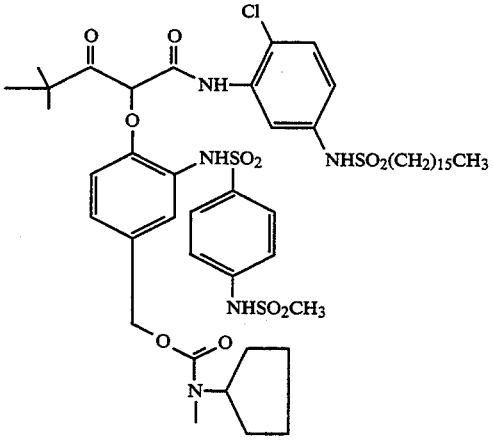
Inv-25
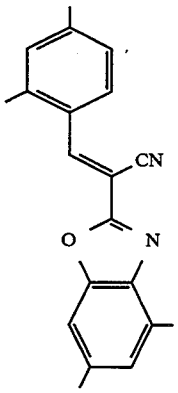
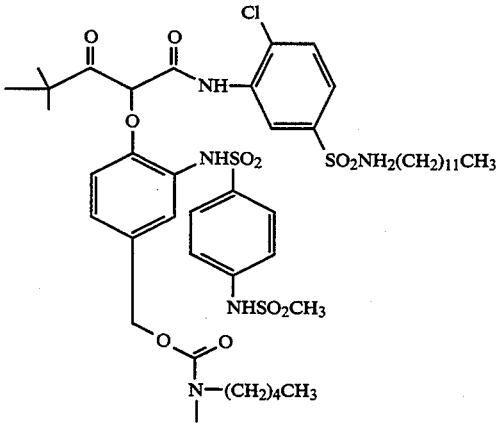
Inv-26

-continued
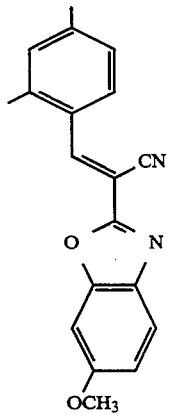
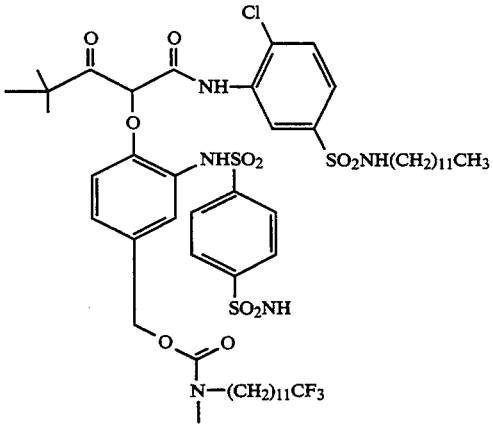
Inv-27
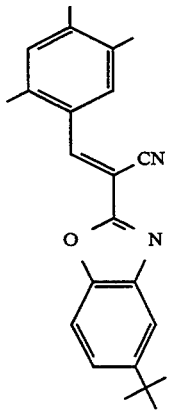
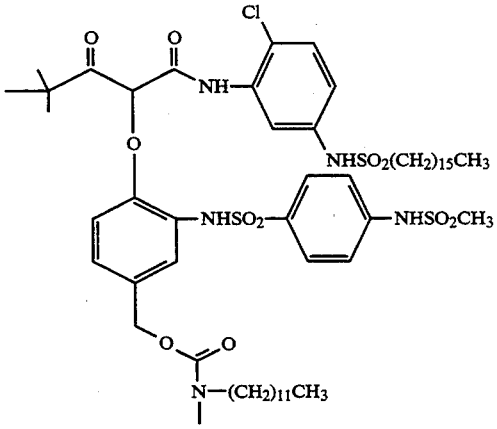
Inv-28

-continued
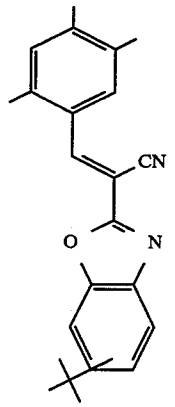
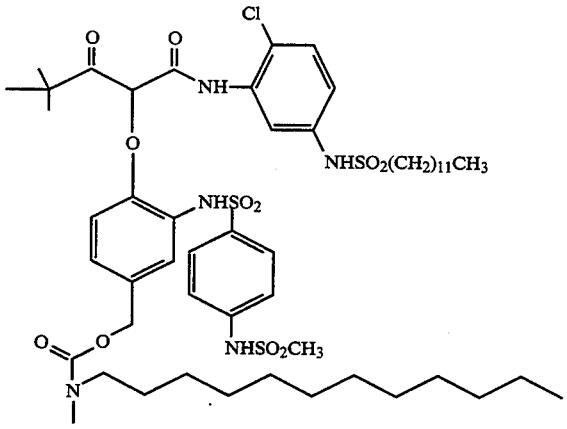
Inv-29
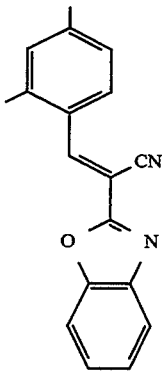
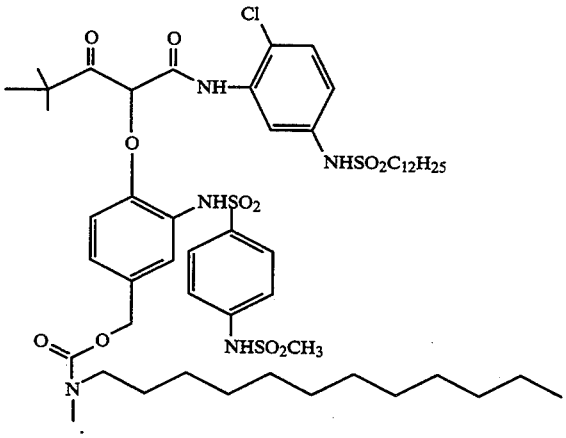
Inv-30

-continued
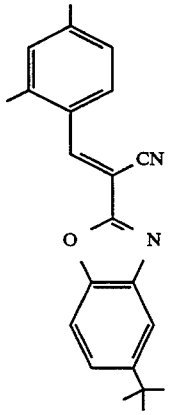
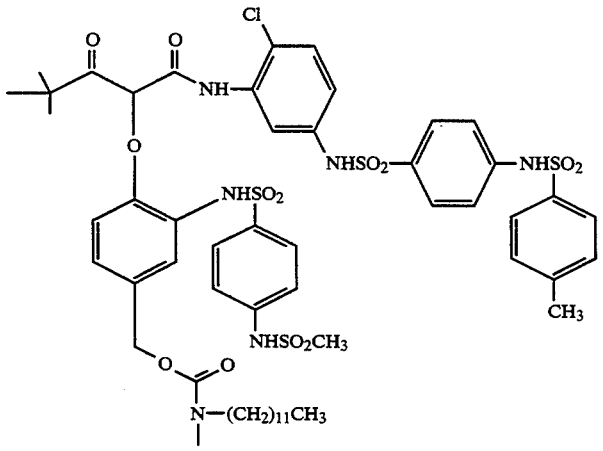
Inv-31
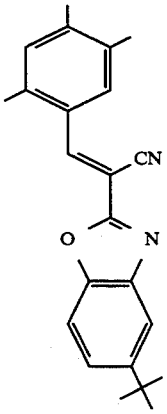

-continued
Inv-32
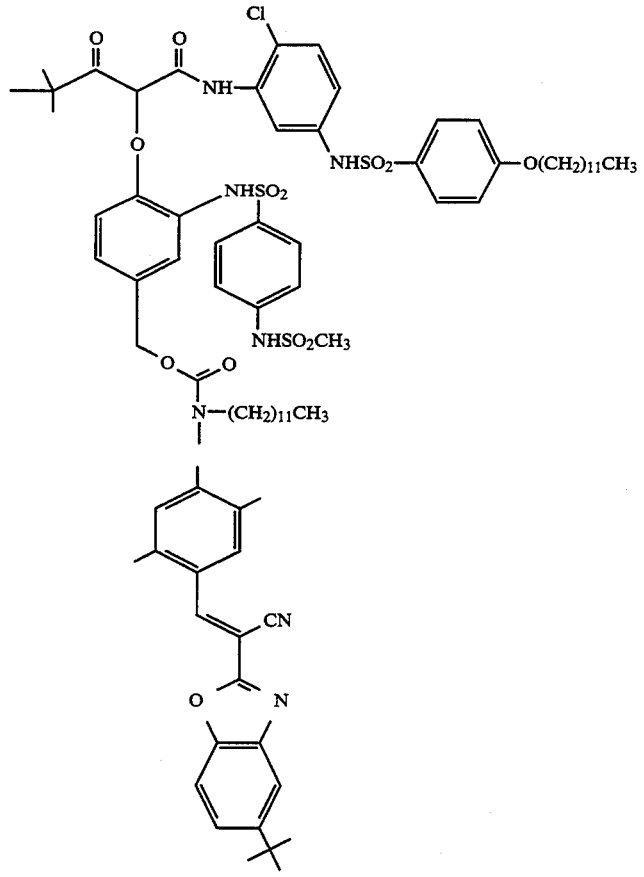
Inv-33
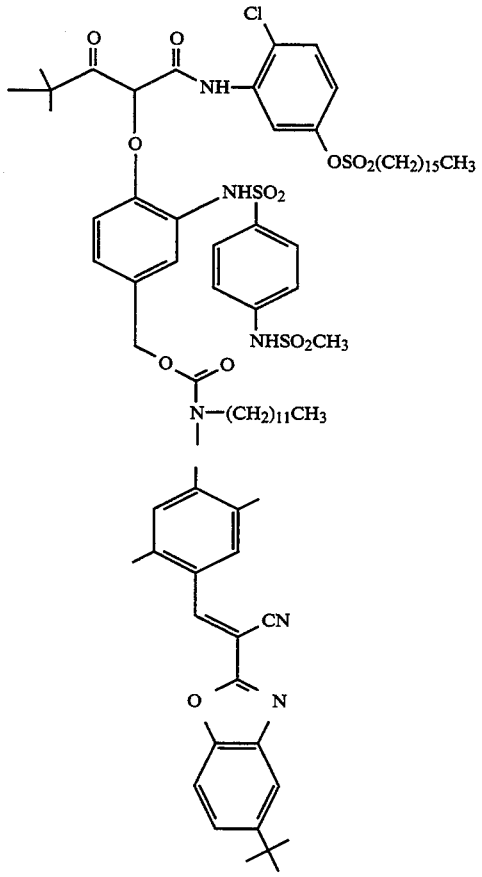

-continued
Inv-34
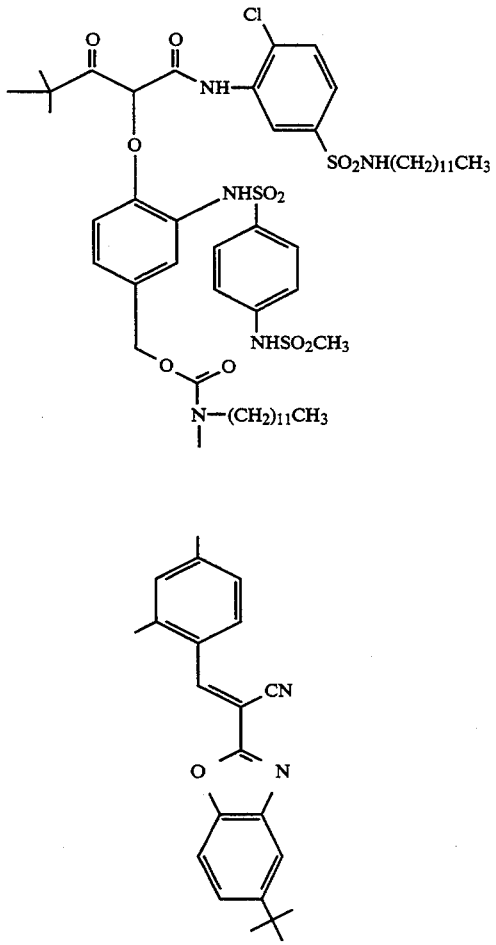
Inv-35
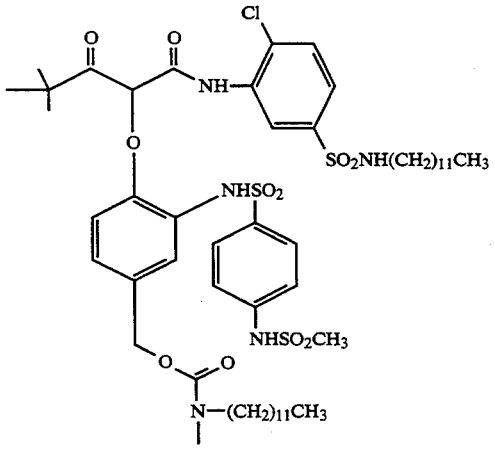

-continued
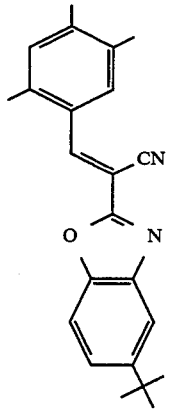
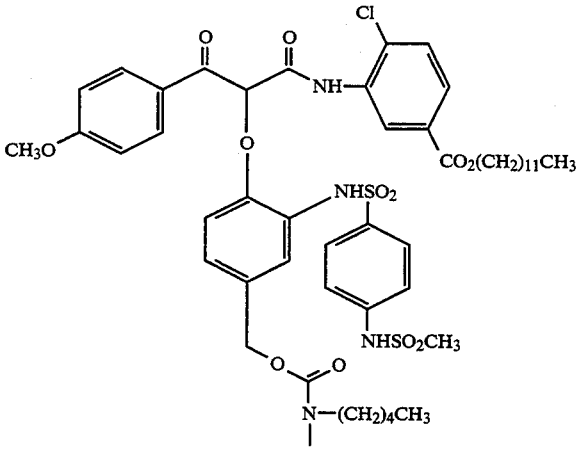
Inv-36
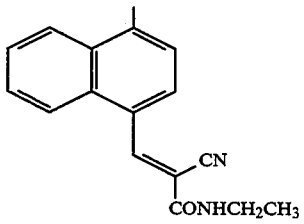
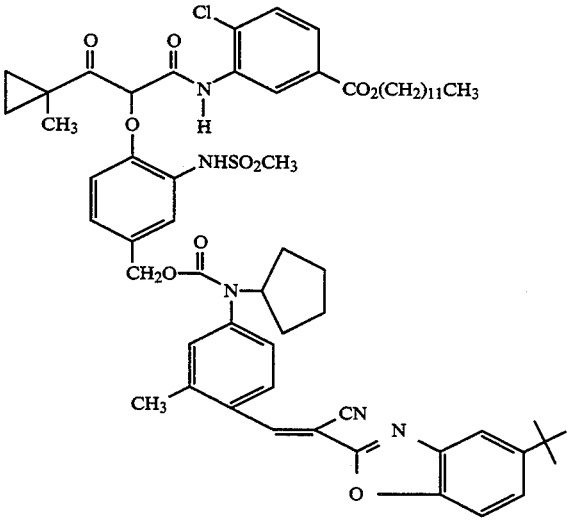
Inv-37

-continued
Inv-38
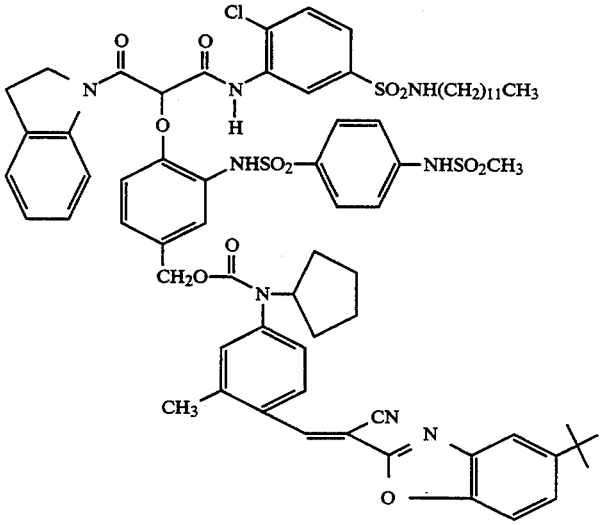
Inv-39
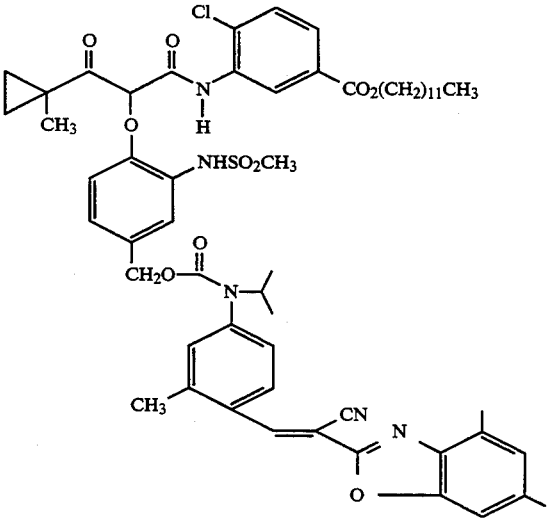
Inv-40
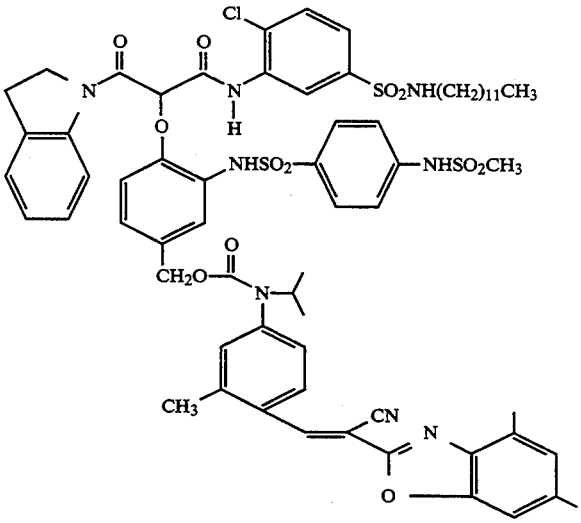

-continued
Inv-41
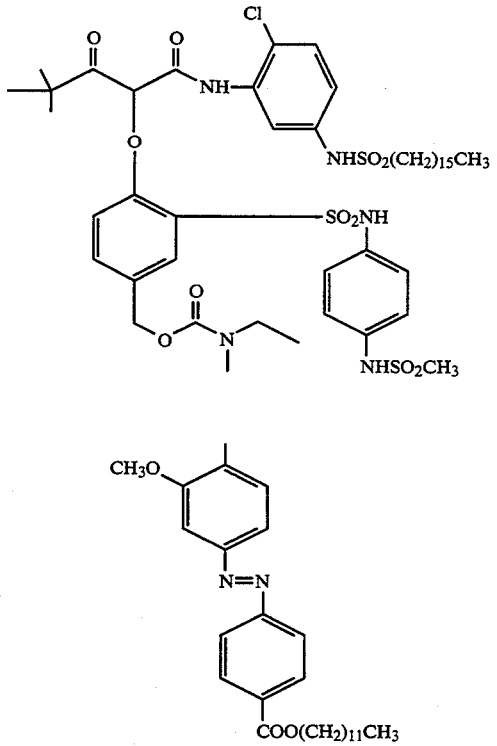
Inv-42
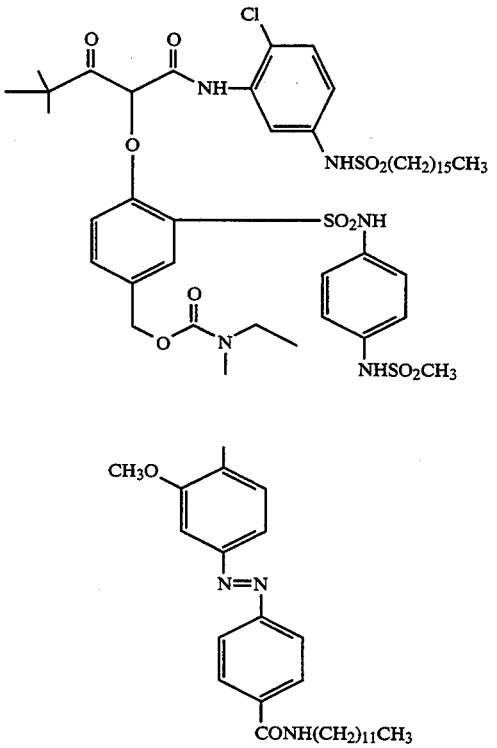

-continued

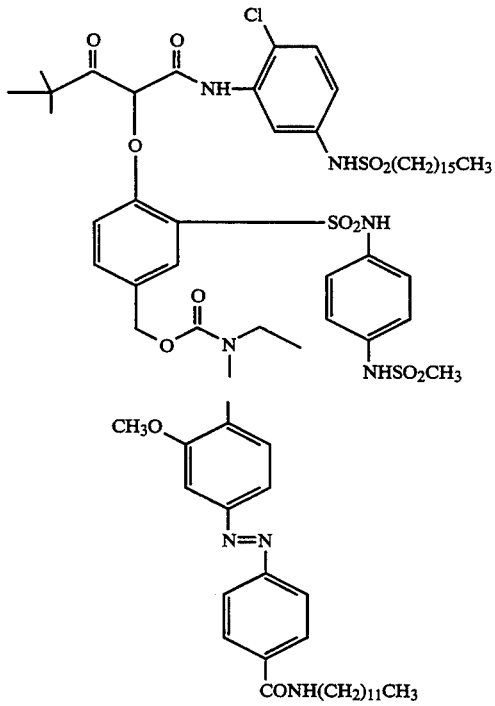

The invention disclosed herein can be used combination with one or more of the inventions disclosed in applications cofiled herewith under application Ser. Nos. 08/250,258; 08/250,742; 08/250,744 and 08/250,199.

Aside from the improved activity and photographic properties, the invention provides benefits relative to elements containing couplers having carboxyl solubilizing groups in the form of simplified synthesis and improved keeping.

The method of the invention provides for the imagewise exposure of a photographic element of the invention followed by contacting the element with a color developing chemical to form a color image. Color forming chemicals are described more fully hereinafter.

As used herein, the term substituent, unless otherwise specifically stated, has a broad definition. The substituent may be, for example, halogen, such as chlorine, bromine or fluorine; nitro; hydroxyl; cyano; and —$CO_2H$ and its salts; and groups which may be further substituted, such as alkyl, including straight or branched chain alkyl, such as methyl, trifluoromethyl, ethyl, t-butyl, 3-(2,4-di-t-amylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-tpentylphenoxy)butyramido, alpha-(3-pentadecylphenoxy)hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl-)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-tpentylphenoxy)-butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl;

thio, such as ethylthio, octylthio, benzylthio, tetradecylthio, 2-(2,4-di-t-pentylphenoxy) ethylthio, phenylthio, 2-butoxy-5-toctylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; azo, such as phenylazo and naphthylazo; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

The particular substituents used may be selected to attain the desired photographic properties for a specific application and can include, for example, hydrophobic groups, solubilizing groups, blocking groups, etc. Generally, the above groups and substituents thereof may typically include those having 1 to 42 carbon atoms and usually less than 24 carbon atoms, but greater numbers are possible depending on the particular substituents selected. Moreover, as indicated, the substituents may themselves be suitably substituted with any of the above groups.

The materials of the invention can be used in any of the ways and in any of the combinations known in the art. Typically, the invention materials are combined with a silver halide emulsion and the mixture is coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting; with silver halide development products.

It may be desirable to include a high molecular weight hydrophobe or "ballast" group in the component molecule to control the migration of various components. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxycarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND; and in U.S. Pat. Nos. 5,252,441; 5,254,449; and 5,254,446; the contents of which are incorporated herein by reference.

Color negative films employing such layers can be employed, in combination with cameras that can record and cause to be stored on such a layer, various useful information related to the use and history of the film. Specific examples include exposure information on a per scene and per roll basis. These films can then be processed in automated processing apparatus that can retrieve film characteristic information as well as film exposure and use information, and optionallly modify the processing to ensure optimal performance and optionally record the details of processing of the magentic layer. The films can then be printed using automated printers that can retrieve both film and process history information and optionally alter, based on the information, exposure characteristics chosen from printing time, printing light intensity, printing light color balance, printing light color temperature, printing magnification or printing lens adjustment, exposure, or printing time, and the color filters so as to enable production of well-balanced display prints from various color originating materials. These layers can be located on the same side of the support as light sensitive layers or arranged so that the support is between the magnetic layer and the light sensitive layers. This information is useful in altering film processing and printing conditions so as to aid in producing a pleasing image.

It is specifically contemplated to employ supports bearing magnetic layers as described.

In the following discussion of suitable materials for use in the emulsions and elements of this invention, reference will be made to *Research Disclosure,* December 1989, Item 308119, available as described above, which will be identified hereafter by the term "Research Disclosure." The contents of the Research Disclosure, including the patents and publications referenced therein, are incorporated herein by reference, and the Sections hereafter referred to are Sections of the Research Disclosure. The materials of the invention may also be used in conjunction with the materials described in *Koukai Gihou No.* 94-6023, Hatsumei Kyoukai, March 1994, available from the Japanese Patent Office, which is incorporated herein by reference.

The silver halide emulsions employed in the elements of this invention can be either negative-working or positive-working. Suitable emulsions and their preparation as well as methods of chemical and spectral sensitization are described in Sections I through IV. Color materials and development modifiers are described in Sections VII and XXI. Vehicles are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, processing methods and agents in Sections XIX and XX, and exposure alternatives in Section XVIII.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,9831,608; 4,070,191; and 4,273,861; German Applications DE 2,706,117 and DE 2,643,965; U.K. Patent 1,530,272; and Japanese Application A-113935. The masking couplers may be shifted or blocked, if desired.

For example, in a color negative element, the materials of the invention may replace or supplement the materials of an element comprising a support bearing the following layers from top to bottom:

(1) one or more overcoat layers containing ultraviolet absorber(s);

(2) a two-coat yellow pack with a fast yellow layer containing "Coupler 1": Benzoic acid, 4-chloro-3-((2-(4-ethoxy-2,5-dioxo-3-(phenylmethyl)-1-imidazolidinyl)-3-(4-methoxyphenyl)-1,3-dioxopropyl-)amino)-, dodecyl ester and a slow yellow layer containing the same compound together with "Coupler 2": Propanoic acid, 2-[[5-[[4-[2-[[[2,4-bis(1,1-dimethyl propyl)phenoxy]acetyl]amino]-5-[(2,2,3,3,4,4,4-heptafluoro-1-oxobutyl)amino]-4-hydroxyphenoxy]-2,3-dihydroxy-6-[(propylamino)carbonyl]phenyl]thio]-1,3,4-thiadiazol-2-yl]thio]-, methyl ester and "Coupler 3": 1-((dodecyloxy)carbonyl) ethyl(3-chloro-4-((3-(2-chloro-4-((1-tridecanoylethoxy) carbonyl)anilino)-3-oxo-2-((4)(5)(6)-(phenoxycarbonyl)-1H-benzotriazol-1-yl)propanoyl)amino))benzoate;

(3) an interlayer containing fine metallic silver;

(4) a triple-coat magenta pack with a fast magenta layer containing "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-, "Coupler 5": Benzamide, 3-((2-(2,4-bis(1,1-dimethylpropyl)phenoxy)-1-oxobutyl)amino)-N-(4',5'-dihydro-5'-oxo-1'-(2,4,6-trichlorophenyl) (1,4'-bi-1H-pyrazol)-3'-yl)-, "Coupler 6": Carbamic acid, (6-(((3-(dodecyloxy)propyl)amino)carbonyl)-5-hydroxy-1-naphthalenyl)-, 2-methylpropyl ester, "Coupler 7": Acetic acid, ((2-((3-(((3-(dodecyloxy)propyl-)amino) carbonyl)-4-hydroxy-8-(((2-methylpropoxy)-carbonyl) amino)-1-naphthalenyl)oxy)ethyl)thio)-, and "Coupler 8" Benzamide, 3-((2-(2,4-bis(1,1-dimethylpropyl) phenoxy)-1-oxobutyl)amino)-N-(4,5-dihydro-4-((4-methoxyphenyl)azo)-5-oxo-1-(2,4,6-trichlorophenyl)-1H-pyrazol-3-yl)-; a mid-magenta layer and a slow magenta layer each containing "Coupler 9": a ternary copolymer containing by weight in the ratio 1:1:2 2-Propenoic acid butyl ester, styrene, and N-[1-(2,4,6-trichlorophenyl)-4,5-dihydro-5-oxo-1H-pyrazol-3-yl]-2-methyl-2-propenamide; and "Coupler 10": Tetradecanamide, N-(4-chloro-3-((4-((4-((2,2-dimethyl-1-oxopropyl)amino)phenyl)azo)-4,5-dihydro-5-oxo-1-(2,4,6-trichlorophenyl)-1H-pyrazol-3-yl)amino)-phenyl)-, in addition to Couplers 3 and 8;

(5) an interlayer;

(6) a triple-coat cyan pack with a fast cyan layer containing Couplers 6 and 7; a mid-cyan containing Coupler 6 and "Coupler 11": 2,7-Naphthalenedisulfonic acid, 5-(acetylamino)-3-((4-(2-((3-(((3-(2,4-bis(1,1-dimethylpropyl)phenoxy)propyl)amino)carbonyl)-4-hydroxy-1-naphthalenyl) oxy)ethoxy)phenyl)azo)-4-hydroxy-, disodium salt; and a slow cyan layer containing Couplers 2 and 6;

(7) an undercoat layer containing Coupler 8; and (8) an antihalation layer.

In a color paper format, the materials of the invention may replace or supplement the materials of an element comprising a support bearing the following layers from top to bottom:

(1) one or more overcoats;

(2) a cyan layer containing "Coupler 1": Butanamide, 2-(2,4-bis(1,1-dimethylpropyl)phenoxy)-N-(3,5-dichloro-2-hydroxy-4-methylphenyl)-, "Coupler 2": Acetamide, 2-(2,4-bis(1,1-dimethylpropyl)phenoxy)-N-(3,5-dichloro-2-hydroxy-4-, and UV Stabilizers: Phenol, 2-(5-chloro-2H-benzotriazol-2-yl)-4,6-bis(1,1-dimethylethyl)-; Phenol, 2-(2H-benzotriazol-2-yl)-4-(1,1-dimethylethyl)-; Phenol, 2-(2H-benzotriazol-2-yl)-4-(1,1-dimethylethyl)-6-(1-methylpropyl)-; and Phenol, 2-(2H-benzotriazol-2-yl)-4,6-bis(1,1-dimethylpropyl) and a poly(t-butylacrylamide) dye stabilizer;

(3) an interlayer;

(4) a magenta layer containing "Coupler 3": Octanamide, 2-[2,4-bis(1,1-dimethylpropyl)phenoxy]-N-[2-(7-chloro-6-methyl-1H-pyrazolo[1,5-b][1,2,4]triazol-2-yl)propyl]- together with 1,1'-Spirobi(1H-indene), 2,2',3,3'-tetrahydro-3,3,3',3'-tetramethyl-5,5',6,6'-tetrapropoxy-;

(5) an interlayer; and (6) a yellow layer sontaining "Coupler 4": 1-Imidazolidineacetamide, N-(5-((2-(2,4-bis(1,1-dimethylpropyl)phenoxy)-1-oxobutyl)amino)-2-chlorophenyl)-.alpha.-(2,2-dimethyl-1-oxopropyl)-4-ethoxy-2,5-dioxo-3-(phenylmethyl)-.

In a reversal format, the materials of the invention may replace or supplement the materials of an element comprising a support bearing the following layers from top to bottom:

(1) one or more overcoat layers;

(2) a nonsensitized silver halide containing layer;

(3) a triple-coat yellow layer pack with a fast yellow layer containing "Coupler 1": Benzoic acid, 4-(1-(((2-chloro-5-((dodecylsulfonyl)amino)phenyl) amino)carbonyl)-3,3-dimethyl-2-oxobutoxy)-, 1-methylethyl ester; a mid yellow layer containing Coupler 1 and "Coupler 2": Benzoic acid, 4-chloro-3-[[2-[4-ethoxy-2,5-dioxo-3-(phenylmethyl)-1-imidazolidinyl]-4,4-dimethyl-1,3-dioxopentyl]amino]-, dodecylester; and a slow yellow layer also containing Coupler 2;

(4) an interlayer;

(5) a layer of fine-grained silver;

(6) an interlayer;

(7) a triple-coated magenta pack with a fast and mid magenta layer containing "Coupler 3": 2-Propenoic acid, butyl ester, polymer with N-[1-(2,5-dichlorophenyl)-4,5-dihydro-5-oxo-1H-pyrazol-3-yl]-2-methyl-2-propenamide; "Coupler 4": Benzamide, 3-((2-(2,4-bis(1,1-dimethylpropyl)phenoxy)-1-oxobutyl)amino)-N-(4,5-dihydro-5-oxo-1-(2,4,6-trichlorophenyl)-1H-pyrazol-3-yl)-; and "Coupler 5": Benzamide, 3-(((2,4-bis(1,1-dimethylpropyl)phenoxy)acetyl)amino)-N-(4,5-dihydro-5-oxo-1-(2,4,6-trichlorophenyl)-1H-pyrazol-3-yl)-; and containing the stabilizer 1,1'-Spirobi (1H-indene), 2,2',3,3'-tetrahydro-3,3,3',3'-tetramethyl-5,5',6,6'-tetrapropoxy-; and in the slow magenta layer Couplers 4 and 5 with the same stabilizer;

(8) one or more interlayers possibly including fine-grained nonsensitized silver halide;

(9) a triple-coated cyan pack with a fast cyan layer containing "Coupler 6": Tetradecanamide, 2-(2-cyanophenoxy)-N-(4-((2,2,3,3,4,4,4-heptafluoro-1-oxobutyl-)amino)-3-hydroxyphenyl)-; a mid cyan containing "Coupler 7": Butanamide, N-(4-((2-(2,4-bis(1,1-dimethylpropyl)phenoxy)-1-oxobutyl)amino)-2-hydroxyphenyl)-2,2,3,3,4,4,4-heptafluoro- and "Coupler 8": Hexanamide, 2-(2,4-bis(1,1-dimethylpropyl)phenoxy)-N-(4-((2,2,3,3,4,4,4-heptafluoro-1-oxobutyl)amino)-3-hydroxyphenyl)-; and a slow cyan layer containing Couplers 6, 7, and 8;

(10) one or more interlayers possibly including fine-grained nonsensitized silver halide; and

(11) an antihalation layer.

The inventive materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,09 9,167; DE 2,842,063, DE 2,937,127; DE 3,636,824; DE 3,64 4,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, tellurotetrazoles or benzisodiazoles. In a preferred embodiment, the inhibitor moiety or group is selected from the following formulas:

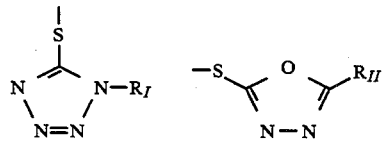

-continued

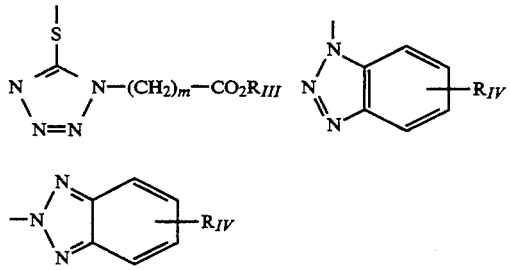

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which groups have been described earlier with respect to the high dye-yield coupler of the invention. Suitable developer inhibitor-releasing couplers for use in the present invention include, but are not limited to, the following:

D1

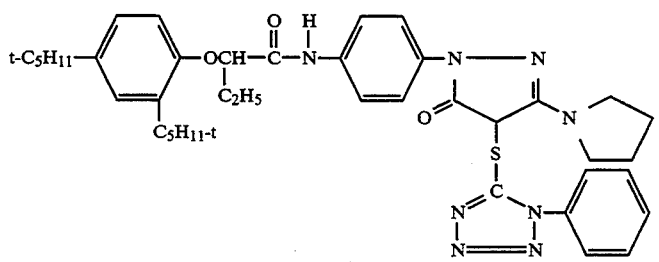

D2

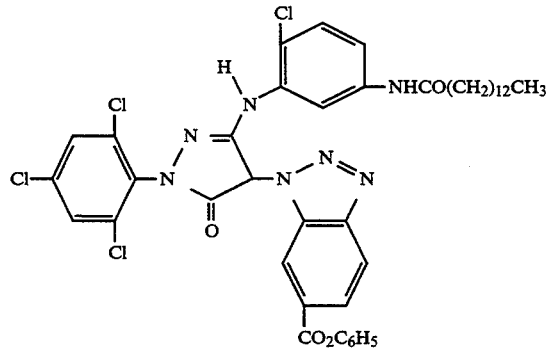

D3

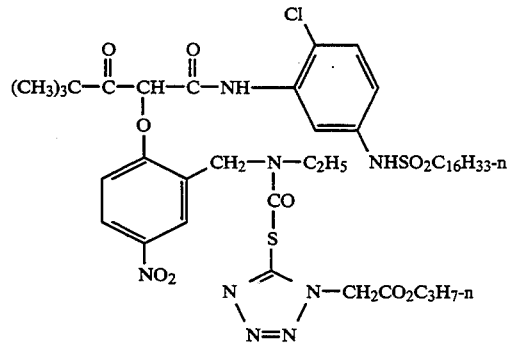

-continued
D4
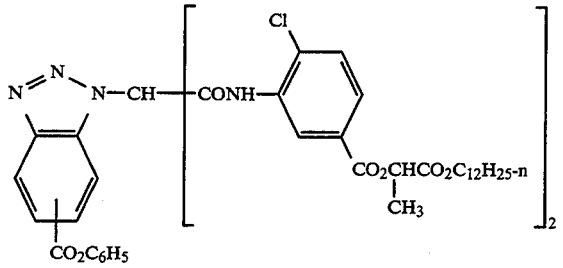
D5
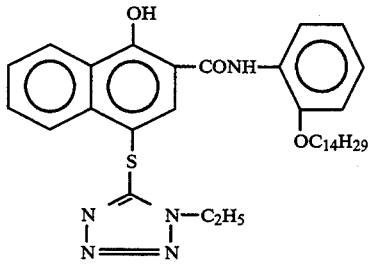
D6
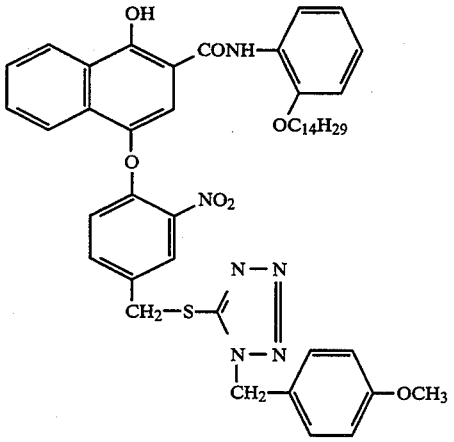
D7
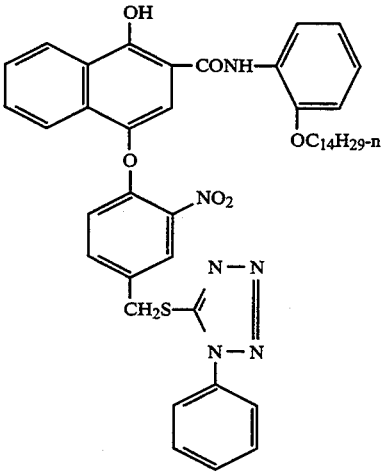

-continued

D8

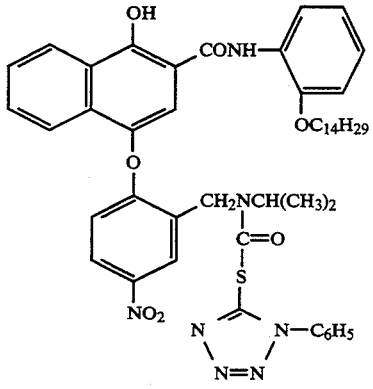

D9

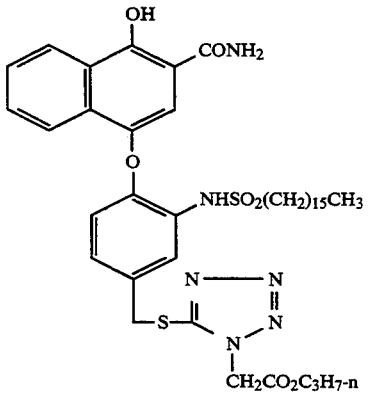

D10

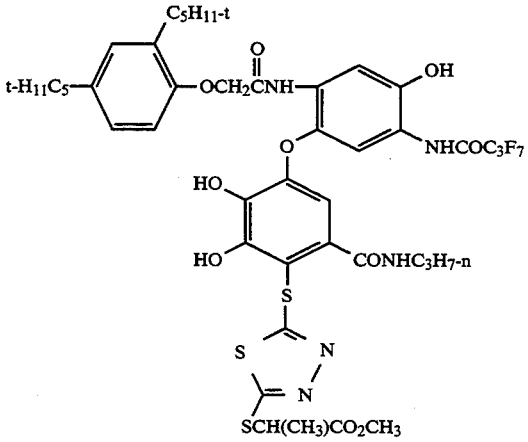

It is also contemplated that the concepts of the present invention may be employed to obtain reflection color prints as described in *Research Disclosure,* November 1979, Item 18716, available from Kenneth Mason Publications, Ltd., Dudley Annex, 12a North Street, Emsworth, Hampshire P0101 7DQ, England, incorporated herein by reference. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

Silver chloride tabular grains useful in this invention include those having {100} major faces. These grains are both morphologically stable and capable of being readily sensitized with a variety of sensitizing dyes. Silver chloride emulsions characterized by at least 50 percent of the grain population projected area being accounted for by tabular grains (1) bounded by {100} major faces having adjacent edge ratios of less than 10 and (2) each having an aspect ratio of at least 2, as described by House et al in allowed U.S. application Ser. No. 112,489 and by Maskasky in U.S. Pat. No. 5,264,337 and allowed U.S. Ser. No. 035,349 the disclosures of which are incorporated herein by reference, are suitable for the invention.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such a the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

It is understood thoroughout this specification and claims that any reference to a substituent by the identification of a group containing a substitutable hydrogen (e.g. alkyl, amine, aryl, alkoxy, heterocyclic, etc.), unless otherwise specifically stated, shall encompass not only the substituent's unsubstituted form, but also its form further substituted with any photographically useful substituents. Usually the further substituent will have less than 30 carbon atoms and typically less than 20 carbon atoms.

The couplers of the invention can be prepared by methods known in the organic synthesis art including those methods described in U.S. Pat. No. 4,840,884.

COUPLER SYNTHESIS

Preparation of Coupler Having the Formula

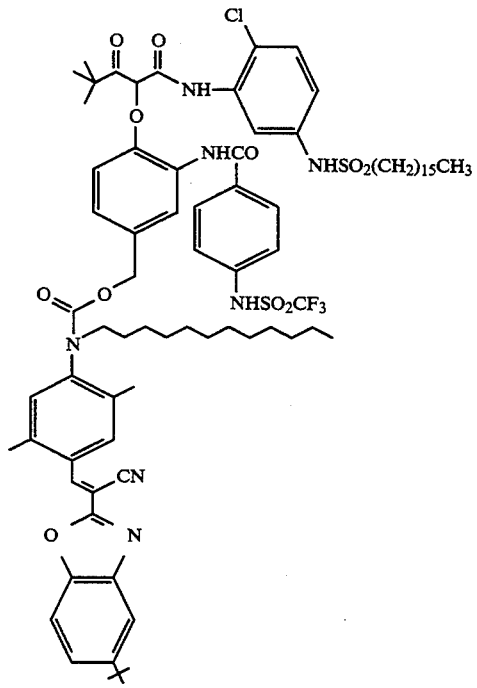

The overall scheme for the synthesis of the coupler is illustrated in Scheme I. The linking group intermediate 10 was prepared in four steps. Commercially available methyl-p-amino benzoate (78.6 g, 0.52 mole) was dissolved in about 500 mL of methylene chloride containing 2,6-lutidine (56 g, 0.52 mole, 60.7 mL), cooled in an ice bath, and treated with trifluoromethane sulfonic anhydride (146 g, 0.52 mole/l in 50 mL of methylene chloride) dropwise over 5 min. The reaction mixture was warmed to room temperature over 30 min before washing with excess 2N HCl. The organic phase was then washed four times with 250 mL portions of 1N $NaHCO_3$. The aqueous washes were acidified with 12N HCl to precipitate a creamy solid which was collected, washed with water, and air dried to yield 86 g of the trifluoromethylsulfonamide (methyl-p-trifluoromethylsulfonamido benzoate). This trifluoromethylsulfonamide (86 g, 0.3 mole) was added to a stirred solution of NaOH (55 g, 1.38 mole) in 660 mL of water. The mixture was stirred for about 15 min before acidifying with excess 2N HCl to yield a precipitate that was collected, washed with water, and air dried to yield 72 g of the saponified benzoic acid. This benzoic acid (74.9 g, 0.278 mole) was converted to acid chloride by stirring in a mixture of 350 mL ethyl acetate, 3 drops of DMF, and 53 g (0.417 mole) oxalyl chloride for 3 hr. Solvents were distilled off under vacuum and residual oxalyl chloride was chased three times with a mixture of 150 mL methylene chloride and 50 mL heptane. The crude oil was mixed with 25 mL of heptane and placed in a refrigerator overnight. The crystals that formed were slurried in about 200 mL of heptane and air dried to yield 57.6 g of the acid chloride. This acid chloride (57.6 g, 0.198 mole, in 100 mL tetrahydrofuran) was added dropwise over 10 min with good stirring to a solution of 3-amino-4-hydroxy benzyl alcohol (27.5 g, 0.198 mole) in 100 mL of pyridine cooled to 5° C. in a 3-neck round-bottomed flask fitted with mechanical stirrer. After 30 min at room temperature, the reaction mixture was diluted with 300 mL of ethyl acetate and washed with excess 2N HCl and water. The organic layer was dried over $MgSO_4$ and stripped to a crude oil that crystallized rapidly with addition of 200 ml heptane. The crystals were collected and air dried to yield 69 g of the linking group 10. This linking group 10 was attached to coupler 11 by combining 32 g (0.082 mole) of 10 and 48.5 g (0.082 mole) of 11 with 200 mL of DMF and treating with tetramethylguanidine (18.8 g, 0.164 mole). The reaction mixture was stirred for 2 hr and then diluted with ethyl acetate and washed with excess 1N HCl and water. The organic layer was dried over $MgSO_4$ and concentrated to an oil. The oil was dissolved in 2 parts of ethyl acetate and diluted with 8 parts heptane. The solvents were evaporated with stirring to yield brown crystals. These crystals were slurried in heptane, collected, and air dried to yield about 60 g of coupler the target coupler.

The dye intermediate 13 was prepared according to Scheme II, illustrated below. Commercially available 2,5-dimethylaniline (50 g, 0.413 mole) was added to formic acid (46 g, 1 mole, 38 mL) in a round-bottomed flask fitted with a condenser and heating mantle. The mixture was heated to reflux for 2 hr and then cooled to room temperature before pouring into 2 L of cold water with good stirring. The resulting precipitate was collected and air dried to yield 61 g of the formamide (2,5-dimethylformanilide). This formamide (59.6 g, 0.4 mole) and bromodecane (104.6 g, 0.4 mole) were mixed with 40 mL t-butanol and 400 mL THF in a 3-neck round-bottomed flask fitted with a reflux condenser, heating mantle, and nitrogen purge. The mixture was treated with potassium t-butoxide (49.2 g), heated to reflux for 12 hr, cooled to room temperature, and diluted with ethyl acetate. The mixture was then washed with excess 1N HCl and water. The organic layer was dried over $MgSO_4$ and concentrated to yield about 120 g of crude alkylated formamide. Alkylated formamide (120 g, 0.38 mole) was dissolved in 420 mL acetic acid and 120 mL 12N HCl and heated to reflux for 16 hr. The solvents were distilled off under vacuum, and the resulting solid was collected and air dried to yield 107 g of the corresponding amine hydrochloride (2,5-dimethyl-N-dodecyl aniline hydrochloride). This amine hydrochloride (34.2 g, 0.105 mole) was mixed with 250 mL acetic acid, 20 mL 12N HCl, and 20 mL formaldehyde in a large mouth 3-L round-bottomed flask fitted with a mechanical stirrer and a heating mantle. The mixture was heated to about 80° C. before removing the heat and treating with N,N-dimethylnitrosoaniline (22.5 g, 0.15 mole) in portions over a 10-min interval with good stirring. The solvents were distilled off under vacuum and the resulting oil was dissolved in300 mL of ethyl acetate and excess 2N HCl. The aqueous phase was washed an additional three times with 300 mL portions of ethyl acetate. These ethyl acetate extracts were passed through a pad of silica gel before removing solvent under vacuum to yield a slurry that crystallized with the addition of 500 mL of heptane. The crystals were collected and air dried to yield 17 g of the aldehyde (2,5-dimethyl-4-dodecylamino-benzaldehyde; DMBA).

Commercially available 4-t-butyl phenol (30 g, 0.2 mole) was dissolved in 200 mL ethyl acetate in a 600-mL round-bottomed flask fitted with a mechanical stirrer, and cooled to 0° C. The mixture was treated with nitric acid (13 mL, in 13 mL water) dropwise over 10 min and then a catalytic amount of $NaNO_2$. After 45 min the reaction was washed with excess 1N HCl and the organic layer was dried over $MgSO_4$ and stripped to yield 37 g of 2-nitro-4-t-butyl phenol. This nitrophenol (37 g, 0.19 mole) was dissolved in 100 mL ethyl acetate and placed into a Parr bottle with a teaspoon of 10% Pd/C. The mixture was: placed on a hydrogenator under 50 psi hydrogen with agitation for 1 hr. The catalyst was filtered off through celite, and the ethyl acetate was stripped off under vacuum. The material crystallized with the addition of about 200 mL heptane to give 25.6 g of the corresponding amine (2-amino-4-t-butyl phenol).

Malononitrile (39.6 g, 0.6 mole) was dissolved in methanol (38 g, 1.2 mole, 48 mL) and 200 mL of methyl formate in a 1-L, 3-neck round-bottomed flask with an ice bath and addition funnel. The mixture was cooled to 10° C. and treated dropwise over 5 min with thionyl chloride (55 g, 0.46 mole, 33.6 mL). A precipitate formed after 30 min and an additional 100 mL of methyl formate was added. After 1 hr the precipitate was collected and air dried for 20 min to yield 52 g of the corresponding imine salt intermediate 14. This salt was stored in an air-tight bottle purged with nitrogen. This imine salt (10.7 g, 0.08 mole) and 2-amino-4-t-butyl phenol (6.6 g, 0.04 mole) were heated with 100 mL methanol at 60° C. for 10 min before diluting with 200 mL of ethyl acetate and excess water. The organic layer was dried over $MgSO_4$ and stripped to yield 8.6 g of the benzoxazole 15. This oil (4.5 g, 0.02 mole) and aldehyde DMBA (6.7 g, 0.02 mole) in 80 mL acetic acid and 3 drops of triethylamine were heated to 80° C. for 15 min and then stirred overnight at room temperature to give a slurry of crystals. The crystals were collected and washed with 100 mL methanol to give two crops yielding about 7 g of the methine dye 16. This dye (3.5 g, 0.0068 mole) was dissolved in about 25 mL methylene chloride and 2,6-lutidine (1.9 g, 0.017 mole). The mixture was treated with phosgene (1.93M in toluene, 0.014 mole, 7.2 mL) over a 1 min interval. After 10 min the mixture was washed in a separatory funnel with excess cold 1N HCl, and then with cold water. The organic phase was dried over $MgSO_4$ and stripped to yield 3.7 g of the carbamoyl chloride 13. After scale-up, this carbamoyl chloride (17.9 g, 0.031 mole) was reacted with coupler 12 (29.3 g, 0.131 mole) in a 1-L, 3-neck round-bottomed flask fitted with nitrogen purge and containing dimethylamino pyridine (3.8 g, 0.031 mole) and 150 mL methylene chloride. The mixture was treated With DBU (14.1 g, 0.093 mole), stirred for 4 hr, diluted with ethyl acetate, and washed with excess 1N HCl and water. The organic layer was dried over $MgSO_4$ and concentrated to a crude oil that was chromatographed on silica gel using methylene chloride/heptane/ethyl acetate (5/3/2) as the eluent. About 20.5 g of the inventive coupler was obtained as a foam.

Scheme I

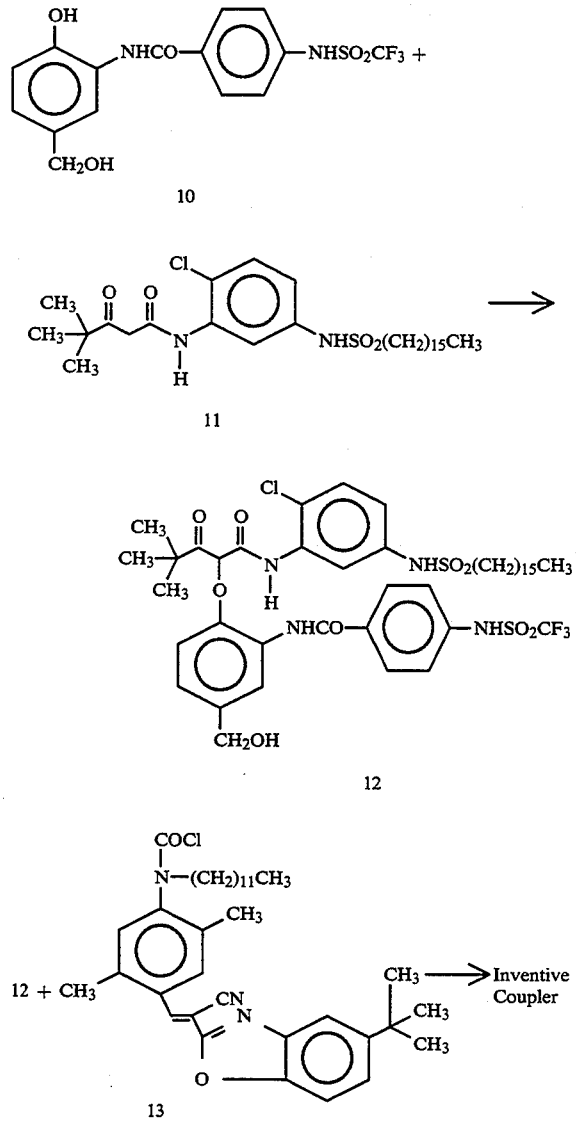

Scheme II

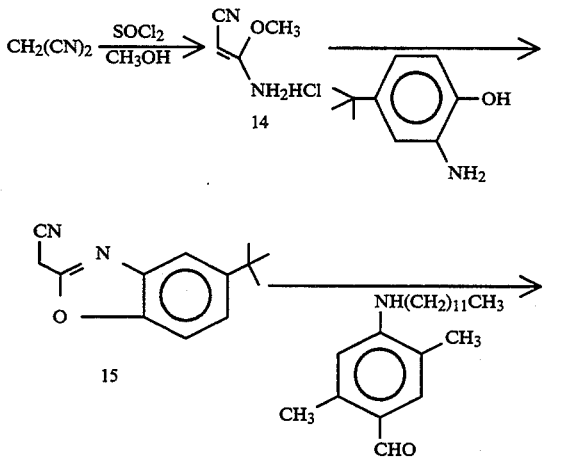

-continued

Scheme II

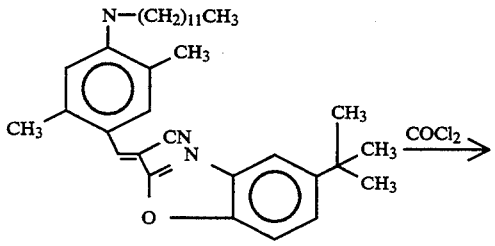

16

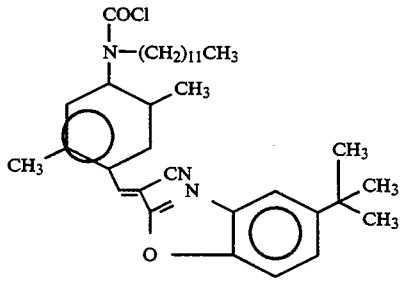

13

PHOTOGRAPHIC EXAMPLES

Format

The following format was employed to prepare inventive and comparative samples containing the couplers as outlined in Table I for testing:

| | |
|---|---|
| Layer 2 | Gelatin 5.38 g/m$^2$ |
| | Hardener 1,1' - (methylene bis (sulfonyl))bis-ethene 2% of total gelatin |
| | Spreading agent 1% of total volume |
| Layer 1 | Gelatin 2.69 g/m$^2$ |
| | Emulsion - tabular silver iodobromide 1.3 × 0.2μ, 4 mole % iodide at 0.40 g/m$^2$ Ag |
| | + Image Coupler at 0.39 (C-1) or 0.19 mM/m$^2$ for the high dye-yield couplers |
| | Spreading agent 1% of total volume |
| | Remjet or Grey Silver antihalation film base |
| | Couplers dispersed in di-n-butyl phthalate. |

Strips corresponding to the samples described in Table I were exposed blue light using a conventional stepwedge and processed using the Kodak Flexicolor C41 process. Formulas for the couplers are shown in the detailed description section.

Table I shows the results of testing various photographic elements according to the invention containing couplers having particular sulfonamide groups compared to the results obtained with the same photographic elements containing similar couplers without the particular solubilizing groups. The table compares the activity of the element as measured by gamma and the useful density as measured by the range of density available between maximum and minimum density as a percentage of the maximum density. The gamma results are all given vs. the corresponding results obtained with conventional coupler C-1 coated at 0.39 mM/m$^2$ as described in the format detail.

TABLE I

C-1

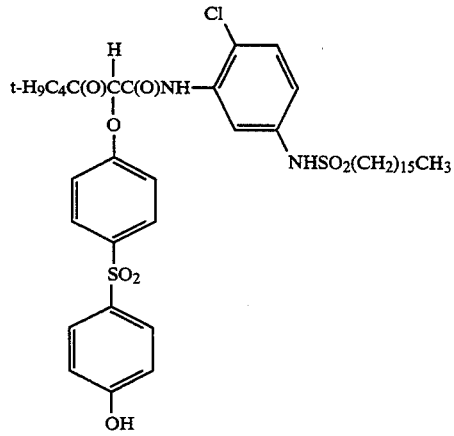

| SAMPLE | COUPLER | TYPE | % GAMMA* | USEFUL DENSITY** - % |
|---|---|---|---|---|
| 1 | Comp-1 | Comp | 124 | 90% |
| 2 | Inv-1 | Inv | 147 | 92% |
| 3 | Comp-2 | Comp | 132 | 85% |
| 4 | Inv-2 | Inv | 147 | 91% |
| 5 | Inv-3 | Inv | 137 | 91% |
| 6 | Comp-3 | Comp | 87 | 75% |
| 7 | Inv-4 | Inv | 101 | 83% |
| 8 | Inv-5 | Inv | 105 | 85% |

*vs Conventional Coupler C-1
**calculated as (Dmax − Dmin)/Dmax

In the first comparison, Comp-1 is compared to Inv-1. The former contains a simple methylsulfonamide solubilizing group while the latter contains a sulfonamidoarylsulfonamide solubilizing group. The results show that a 23% improvement in gamma and a 2% improvement in useful density are obtained.

In the second comparison, Comp-2 containing a carboxylated propylenecarbonamido group, is compared to Inv-2, containing the same coupler except for having the solubilizing group of Inv-1, and to Inv-3, containing the same coupler except for having a p-trifluorosulfonamidophenylcarbonamide solubilizing group. Here, the invention provides a 5–15% improvement in gamma and a 6% improvement in useful density.

In the third comparison, Comp-3, containing the same solubilizing substituent as Comp-2, is compared to an element containing the same coupler except that Inv-4 contains a solubilizing group as in Inv-1 and Inv-5 contains the solubilizing group of Inv-3. Here the gamma is seen to have improved by 14 to 18% and the useful density has improved by from 8 to 10%.

Testing without direct comparisons revealed that the solubilizing group of the invention provided significant increases in gamma and in useful density over the conventional coupler C-1 in the same manner as the inventive compounds described above.

The preceding examples are set forth to illustrate specific embodiments of this invention and are not intended to limit the scope of the materials or combinations of this invention. Additional embodiments and advantages within the scope of the claimed invention will be apparent to one skilled in the art. All previously cited patents, publications, and cofiled and copending patent applications are incorporated herein by reference in their entirety.

What is claimed is:

1. A photographic element comprising a support bearing a photographic silver halide emulsion layer having associated therewith a high dye-yield coupler having the formula:

$$COUP—(T)_m—L—DYE$$

where COUP is the parent group of the coupler capable of reacting at the coupling position with oxidized color developer to form a first dye, T is one or more timing groups with m=1 or 2, L is a linking group selected from the group consisting of —OC(O)—, —OC(S)—, —SC(O)—, —SC(S)—, or —OC(=$NSO_2R$)—, where R is substituted or unsubstituted alkyl or aryl, and DYE is a second dye or precursor thereof, wherein there is present at least one T group that contains a substituent having the formula:

$$—(LINK)_p—A—B—(C—D)_n$$

wherein:

LINK is an alkylene group capable of linking the above group to the group T, where p=0 or 1;

A is a member selected from the group consisting of —NHCO—, —N(R')C(O)N(R')—, —CONH—, —NR'$SO_2$—, —$SO_2$NR'—, and —$OPO_2$—, where R' is hydrogen or substituted or unsubstituted alkyl;

B is a substituted or unsubstituted aromatic carbocyclic or heterocyclic group;

C is a solubilizing group selected from —$NHSO_2$— and —$SO_2$NH—; and

D is a substituted or unsubstituted alkyl, aryl, or heterocyclic ring, and n is from 1 to 3.

2. The element of claim 1 wherein R' is hydrogen.

3. The element of claim 2 wherein D contains less than 6 carbon atoms.

4. The element of claim 3 wherein D is a substituted or unsubstituted methyl group.

5. The element of claim 4 wherein D is trifluoromethyl.

6. The element of claim 4 wherein D is methyl.

7. The element of claim 1 wherein B is phenyl.

8. The element of claim 1 wherein A is —NHCO—.

9. The element of claim 1 wherein A is —$NHSO_2$—.

10. The element of claim 1 wherein COUP is selected from the group consisting of couplers capable of forming a yellow first dye.

11. The element of claim 10 wherein COUP is an open chain ketomethylene compound.

12. The element of claim 1 wherein L is —OC(O)—.

13. The element of claim 1 wherein at least one T is selected from those having a bond from COUP or another timing group to an oxygen atom which is bonded to a substituted or unsubstituted aromatic hydrocarbyl or heterocyclic ring at a location in conjugation with a methylene group on said hydrocarbyl or heterocyclic ring, which methylene group may optionally be substituted with one or two alkyl groups, where the methylene group is bonded to L—DYE or a second timing group.

14. The element of claim 13 wherein —$(LINK)_m$—A—B— $(C—D)_n$ is selected from the group consisting of:

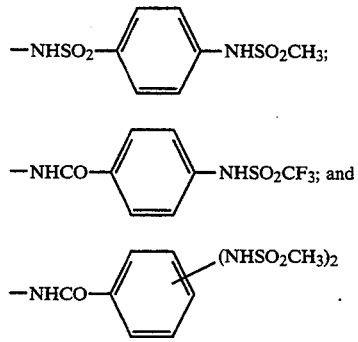

15. The element of claim 1 wherein at least one T has the formula:

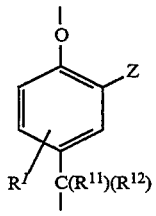

wherein Z is selected from the group consisting of nitro, cyano, alkylsulfonyl; sulfamoyl (—$SO_2NR_2$); and sulfonamido (—$NRSO_2R$) groups; R is hydrogen or a substituent such as alkyl; $R^I$, $R^{11}$ and $R^{12}$ are independently hydrogen or substituents that do not adversely affect the coupling and release reactions or the properties of the dyes formed thereby.

16. A photographic emulsion comprising photographic silver halide grains having associated therewith a high dye-yield coupler having the formula:

$$COUP—(T)_m—L—DYE$$

where COUP is the parent group of the coupler capable of reacting at the coupling position with oxidized color developer to form a first dye, T is one or more timing groups with m=1 or 2, L is a linking group selected from the group consisting of —OC(O)—, —OC(S)—, —SC(O)—, —SC(S)—, or —OC(=$NSO_2R$)—, where R is substituted or unsubstituted alkyl or aryl, and DYE is a second dye or precursor thereof, wherein there is present at least one T group that contains a substituent having the formula:

$$—(LINK)_p—A—B—(C—D)_n$$

wherein:

LINK is an alkylene group capable of linking the above group to the group T, where p=0 or 1;

A is a member selected from the group consisting of —NHCO—, —N(R')C(O)N(R')—, —CONH—, —NR'$SO_2$—, —$SO_2$NR'—, and —$OPO_2$—, where R' is hydrogen or substituted or unsubstituted alkyl;

B is a substituted or unsubstituted aromatic carbocyclic or heterocyclic group;

C is a solubilizing group :selected from —$NHSO_2$— and —$SO_2$NH—; and

D is a substituted or unsubstituted alkyl, aryl, or heterocyclic ring, where n is from 1 to 3.

17. A method of forming a color image in a photographic element as described in claim 1 which has been imagewise exposed, comprising contacting said element with a color developer.

* * * * *